US005818157A

United States Patent [19]

Stil et al.

[11] Patent Number: 5,818,157

[45] Date of Patent: Oct. 6, 1998

[54] COLOR CATHODE RAY TUBE HAVING AN IN-LINE ELECTRON GUN WITH ASYMMETRICAL APERTURES

[75] Inventors: Lambert J. Stil; Johannes H. Bohlander; Tjerk G. Spanjer; Abraham A. Los; Antonius J. Pennings, all of Eindhoven, Netherlands

[73] Assignee: U.S. Philips Corporation, New York, N.Y.

[21] Appl. No.: 869,472

[22] Filed: Jun. 5, 1997

Related U.S. Application Data

[63] Continuation of Ser. No. 437,740, May 9, 1995, abandoned.

[30] Foreign Application Priority Data

May 10, 1994 [EP] European Pat. Off. ..... 94201311
Jul. 19, 1994 [EP] European Pat. Off. ..... 94202104

[51] Int. Cl.[6] ..... H01J 26/62

[52] U.S. Cl. ..... 313/414; 313/412; 315/382.1; 315/14

[58] Field of Search ..... 313/414, 412, 313/413, 449, 458; 315/382, 382.1, 14, 15

[56] References Cited

U.S. PATENT DOCUMENTS

| | | | |
|---|---|---|---|
| 4,626,738 | 12/1986 | Gerlach | 313/414 |
| 4,766,344 | 8/1988 | Say | 313/414 |
| 4,940,911 | 7/1990 | Stil | 313/414 |
| 5,146,133 | 9/1992 | Shirai et al. | 313/414 |

*Primary Examiner*—Sandra L. O'Shea
*Assistant Examiner*—Michael Day
*Attorney, Agent, or Firm*—Robert J. Kraus

[57] ABSTRACT

A color cathode ray tube includes an in-line electron gun having a main lens with recessed apertures. The main lens is formed by two electrodes. These electrodes have outer edges and recessed apertures which allow passage of three in-line electron beams and which are arranged at a distance d1 and d2, respectively, from the outer edges. The outermost apertures are asymmetric. The difference d1–d2 and the asymmetry of the outermost apertures is such that both the beam displacement and the core haze asymmetry are minimal.

6 Claims, 6 Drawing Sheets

P=0

P=0

P = -0.5

P = -0.218

$$P = 0.273 \frac{(a_1 - a_2)}{(a_1 + a_2)}$$

COLOR CATHODE RAY TUBE HAVING AN IN-LINE ELECTRON GUN WITH ASYMMETRICAL APERTURES

This is a continuation of application Ser. No. 08/437,740, filed May 9, 1995, now abandoned.

BACKGROUND OF THE INVENTION

The invention relates to a color cathode ray tube comprising an electron gun having a main lens portion which contains a first and a second electrode, the first and second electrodes each having three in-line apertures and an outer edge, the outer edges of the electrodes facing each other and the apertures being recessed with respect to the edge of the relevant outer edge.

Cathode ray tubes of the type mentioned in the opening paragraph are well-known.

In the construction of an electron gun, a number of important parameters must be taken into account, such as the so-called spot error (SE), the beam displacement (BD) and the core haze asymmetry (CHA). The electron gun has a number of lenses which have a convergent or divergent effect on the electron beams. Displacement and tilting of the electrodes used to form the lenses causes displacement of the lenses, resulting in an undesired deflection of the electron beam. If this occurs in the main lens, then the electron beam impinges on the display screen in the wrong place, which results in a spot error. A further effect which occurs when the electron beam eccentrically passes through the main lens is that the border rays of the electron beam undergo a greater deflection on one side than on the other side. The effect on the display screen is termed core haze asymmetry. Further, a change of the strength of the main lens causes a displacement of the beam on the display screen, this phenomenon is commonly referred to as beam displacement. As will be explained hereinbelow, the core haze asymmetry decreases as the picture sharpness increases. Problems with the red-blue convergence occur as a result of the beam displacement. These problems adversely affect the picture quality.

OBJECTS AND SUMMARY OF THE INVENTION

It is an object of the invention to provide a cathode ray tube of the type mentioned in the opening paragraph, which enables the picture quality to be improved.

To this end, a colour cathode ray tube in accordance with the invention is characterized in that the distances between the edges of the collars and the plates differ to such an extent, and the outermost apertures exhibit such a left-right asymmetry, that the core haze asymmetry is less than 50 volts and the beam displacement is less than 0.2 mm.

Within the scope of the invention, left-right asymmetry is to be understood to mean that, with respect to a (y or vertical) line at right angles to a(n) (x or horizontal) line in the in-line plane and through a point situated centrally between the outermost edges of an aperture in a direction (the x or horizontal direction) in the in-line plane, the surfaces of the portions of the apertures on either side of the line are not mirror symmetrical with respect to the line. Examples of apertures which meet this condition are ovoid apertures.

Each of the plates having three apertures is situated at a distance d1, d2 for, respectively, the first electrode and the second electrode. Hereinafter, this difference will also be referred to as "difference in depth".

Within the scope of the invention, it has been recognized that both the core haze asymmetry and the beam displacement change as a function of the difference in depth and of the "ovoidness" of the outermost apertures, and that it is advantageous and possible to select the combination of difference in depth and "ovoidness" in such a manner that the path of the outermost electrons through the outermost apertures coincides with the path for which the core haze asymmetry is negligible and that this path coincides with the path for which the beam displacement is substantially negligible.

The core haze asymmetry is defined by and can be measured by the difference in voltage on the first electrode at which the left-hand side and right-hand side of the spot of the outermost beams are in focus on the display screen, measured in the center of the display screen. In color ray tubes in accordance with the invention, this difference is less than 50 volts.

The beam displacement is also measured in the centre of the display screen by varying the potential applied to the second electrode between 20 and 30 kV, while the potential applied to the first electrode remains substantially constant, and by measuring the beam displacement of the outermost electron beams, i.e. the difference in position at, respectively, 20 and 30 kV, in the centre of the display screen. In colour cathode ray tubes in accordance with the invention, the beam displacement is less than 0.2 mm.

Preferably, the left-right asymmetry, expressed by means of the left-right asymmetry factor p, and the difference (d1−d2) in distance between the edges of the collars and the plates, are in the range indicated by the area in FIG. 8, which is defined by the lines which correspond to a beam displacement of 0.2 mm and −0.2 mm.

Preferably, the difference in depth (d1−d2) is approximately 0 mm. This enables the use of two identical electrodes.

BRIEF DESCRIPTION OF THE DRAWINGS

These and further aspects of the invention will be explained in greater detail by means of exemplary embodiments and with reference to the accompanying drawings, in which

The Figures are not drawn to scale. In general, like reference numerals refer to like parts in the Figures.

The display device has a cathode ray tube, in this example colour display tube 1, which comprises an evacuated envelope 2 consisting of a display window 3, a cone portion 4 and a neck 5. In the neck 5 there is provided an electron gun 6 for generating three electron beams 7, 8 and 9 which extend in one plane, the in-line plane, which in this case is the plane of the drawing. A display screen 10 is provided on the inside of the display window. The display screen 10 comprises a large number of phosphor elements luminescing in red, green and blue. On their way to the display screen, the electron beams are deflected across the display screen 10 by means of an electromagnetic deflection unit 11 and pass through a color selection electrode 12 which is arranged in front of the display window 3 and which comprises a thin plate having an aperture 13. The color selection electrode is suspended in the display window by means of suspension elements 14. The three electron beams 7, 8 and 9 pass through the apertures 13 of the color selection electrode at a small angle with respect to each other and, consequently, each electron beam impinges on phosphor elements of only one color. The display device further comprises means 15 for generating, in operation, voltages which are applied to parts of the electron gun via feedthroughs 16. FIG. 2 is a sectional view of an electron gun 6. The electron gun comprises three cathodes 21, 22 and 23. The electron gun further comprises a first common electrode 20 ($G_1$), a second common electrode 24 ($G_2$), a third common electrode 25 ($G_3$) and a fourth common electrode 26 ($G_4$). The electrodes have connections for applying voltages. The display device comprises leads, not shown, for applying voltages, which are generated in means 15, to the electrodes. By applying voltages and, in particular, by voltage differences between electrodes and/or sub-electrodes, electron-optical fields are generated. Electrodes 26 ($G_4$) and sub-electrode 25 ($G_3$) constitute an electron-optical element for generating a main lens field which, in operation, is formed between these electrodes. The electrodes are interconnected by means of connecting elements, in this example glass rods 27.

FIG. 3 is a schematic, sectional view of the electron gun shown in FIG. 2. The electrodes 25 ($G_3$) and 26 ($G_4$) each comprise plates 30 and 40 having apertures 31, 32, 33 and 41, 42, 43, respectively. These plates are recessed with respect to the outer edges or collars 34 and 44 of the electrodes 25 and 26, respectively. The distance between the outer edges and the plates in the z-direction is indicated in the Figures and is equal to, respectively, d1 and d2.

FIG. 4 is a top view of a plate 30 having apertures 31, 32 and 33. The outermost apertures 31 and 33 are asymmetric, in the sense that they are asymmetric with respect to a line 51 which extends at right angles to a line 52 which runs through the centers of the apertures. The lines 51 divide the apertures 31 and 33 in two portions 53 and 54, the length of the line segments 55 and 56 being the same. The surface areas A2 and A1, however, of these portions 53 and 54 are not the same. The apertures 31 and 33 exhibit a left-right asymmetry. This asymmetry can be expresed by a factor p, where p is the difference (A1−A2) in surface area between the portions 53 and 54, divided by the sum (A1+A2) of said surface areas. This factor p carries a negative sign if the "innermost" portion (53), i.e. the portion of the aperture which is closest to the central aperture, has a larger surface area A2 than the portion (54) which is farthest from the central aperture, p=(54−53)/(54+53).

FIG. 5 shows a number of shapes of the apertures 31 and 33 as well as the associated factors p. In the FIGS. 5*a* up to and including 5*e*, the central aperture (not shown) is positioned to the left of the apertures shown. For a circle (FIG. 5*a*) and an ellipse (FIG. 5*b*) p=0, for an equilateral triangle (FIG. 5*c*) p=−0.5. For a semi-circle (FIG. 5*d*) p=−0.218 and for two half ellipses having an equal vertical axis b and horizontal axes a1 and a2, respectively, (FIG. 5*e*), in a first-order approximation (a1−a2<a1+a2), p=−0.273 (a1−a2)/(a1+a2). In the last Figure, the boundary between the two half ellipses is indicated by a dotted line.

The main lens, in this example formed by electrodes G3 and G4, focuses the electron beams on the display screen. Errors may occur in this focusing operation. A first error is the so-called beam displacement. FIG. 6 schematically illustrates this error. In this example, the triode and the main lens are schematically indicated by lenses 61 and 62. The electron beam eccentrically enters the main lens. If the voltage on G4 is varied (the voltages on G3 remaining the same), then the position of the electron beam in the centre of the screen 63 changes. The beam displacement BD is commonly measured as the difference in position of the electron beam on the screen, which occurs when the voltage on G4 is changed from 20 to 30 kV (kilovolts). The main reason why beam displacement constitutes a problem is that the beam displacements of the outermost electron beams R and B are of opposite sign. Due thereto, a variation of the voltage on G4 leads to red-blue convergence errors. In practice, a variation of the voltage on G4 of several kV occurs.

A second error is the so-called core haze asymmetry. FIGS. 7A and 7B schematically illustrate this effect. An electron beam 71 formed in triode portion 72 of the electron gun enters the main lens 73 and is focused on the screen 74. If spherical aberration of the lens causes the border rays to be more strongly deflected on one side than on the other side by the main lens, an asymmetric haze 76 is formed around the core 75 of the electron spot. Such a haze leads to a reduced picture sharpness. The magnitude of this effect can be expressed as a potential difference, i.e. a difference between the potentials on G3, such that, for the center of the display screen, the left-hand side of the core or the right-hand side of the core are in focus. If this difference is approximately 0 volt, then the electron beam follows a so-called coma-free path through the main lens. The loss of sharpness is caused by the fact that, in practice, the highest voltage of the two focus voltages $V_{G3}$ is set. FIG. 7B illustrates the loss of sharpness. The voltage $V_{G3}$ is plotted on the horizontal axis and spot size is plotted on the vertical axis. The edge of core 75 is shown by means of solid lines; the edge of the haze 76 is shown by means of interrupted lines. At a high value of $V_{G3}$ no haze occurs. The solid lines 81 and the interrupted lines 82 represent the ideal situation when there is absolutely no core haze asymmetry. If $V_{G3} \geqq V_{foc,R}$ a haze occurs. In such a case, the voltage on G3 is adjusted so that $V_{G3}=V_{foc}$. The spot size is indicated by the length of arrow 83. Lines 84 and 85 represent the spot size of, respectively, the right-hand side and left-hand side of the core of the spot when core haze asymmetry occurs. Lines 86 and 87 represent the size of the haze, respectively, on the right-hand side and left-hand side of the spot. In this example, core haze asymmetry occurs because the haze on the right-hand side of the spot is larger than on the left-hand side of the spot. In this example, a haze occurs for the right-hand side of the spot if $V_{G3}<V_{foc,R}$ and for the left-hand side of the spot if $V_{G3}<V_{foc,L}$. At $V_{G3}=V_{foc,L}$ the spot size is represented by the size of the arrow 88'. The voltage on G3 is adjusted so that absolutely no haze occurs, i.e. $V_{G3}<V_{foc,R}$. The spot size at this setting is represented by the size of arrow 88. It is obvious that the spot size has been enlarged with respect to the ideal size (no core haze asymmetry). The core haze asymmetry is defined by $V_{foc,R}-V_{foc,L}$=CHA.

FIG. 8 shows the beam displacement (BD), in mm, for electrodes having outermost apertures formed by two half ellipses as shown in FIG. 5*e*, as a function of the difference in depth d1−d2, in mm, plotted along the horizontal axis, and as a function of p plotted along the vertical axis. The lens is constructed so that the core haze asymmetry is less than 50

V and approximately equal to 0 volt. In this example, the electron-optical pitch between the apertures, which in a zero-order approximation is equal to the distance between the geometric centres of the apertures (geometric pitch), is equal to 5.5 mm (in a first-order approximation the geometric pitch is several tenths of a mm larger than the electron-optical pitch, i.e. in this example between 5.7 and 6.3 mm). FIG. 9 shows the relationship between the electron-optical pitch e and the geometric pitch. FIG. 10 shows the depths d1 and d2 which, in this example, are approximately 3.2 mm. In FIG. 10, the apertures are provided in plates 101 which are secured in electrodes 102. This is a preferred embodiment. The electrodes may be made by deep drawing (as shown in the sectional view of FIG. 3). However, the use of plates 101 as shown in FIG. 10 is preferred, as the distances $d_1$ and $d_2$ can be set more accurately and the apertures can be made more accurately and designed with a greater degee of freedom. For example, in the case of an electrode as shown in FIG. 3, there must always be a distance between the edge of aperture 31 and the edge 34. This limitation does not apply to apertures in the plates 101. FIG. 8 shows that by varying the difference in depth (d1−d2) and the factor p for a core haze asymmetry which is substantially 0 (<50 volts), a beam displacement which is substantially 0 can be attained. A colour cathode ray tube in accordance with the invention is characterized in that the distances between the edges of the collars and the plates (d1−d2) are different and in that the outermost apertures (31, 33) exhibit a left-right asymmetry and, in operation, the core-haze asymmetry being less than 50 volts and the beam displacement, as an absolute value, being less than 0.2 mm. In FIG. 8, this is indicated by the area within the lines defined by 0.2 and −0.2. This area approximately corresponds to a hexagon having vertices at the points:

$A(d_1-d_2, p)=(0, -0.034)$
$B(d_1-d_2, p)=(0.124, -0.0146)$
$C(d_1-d_2, p)=(0.169, 0)$
$F(d_1-d_2, p)=(0.272, 0)$
$E(d_1-d_2, p)=(0.194, -0.022)$
$D(d_1-d_2, p)=(0, -0.052)$

Figure 1:
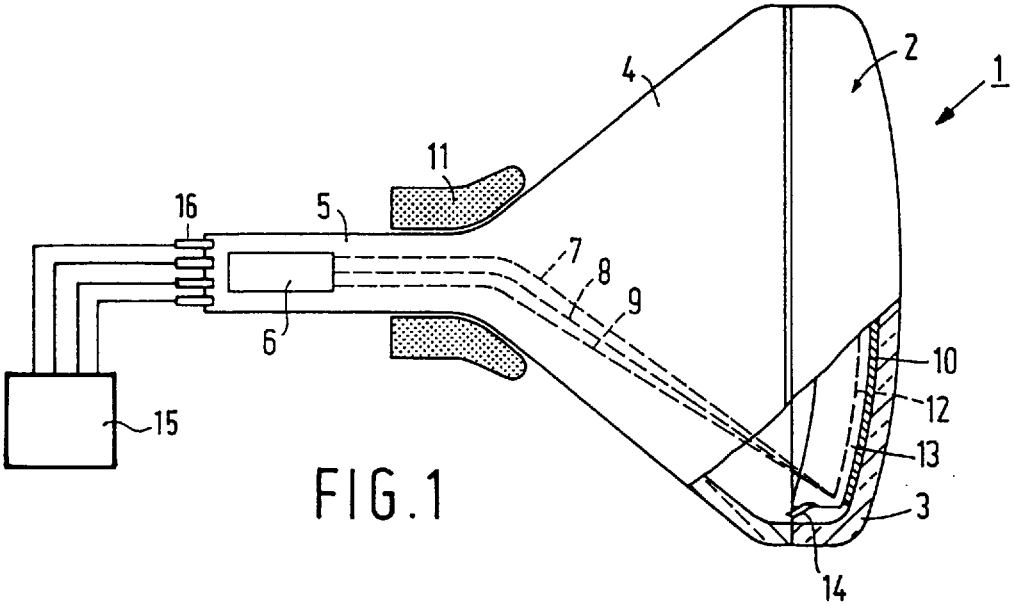
FIG. 1 is a sectional view of a display device.
Figure 2:
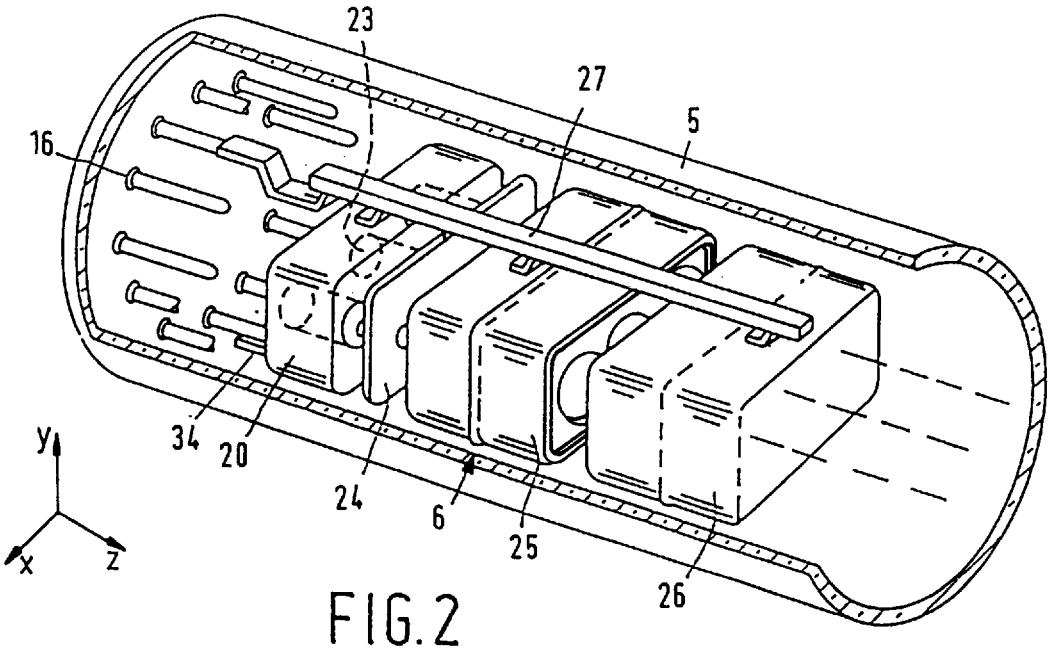
FIG. 2 is a sectional view of an electron gun.
Figure 3:
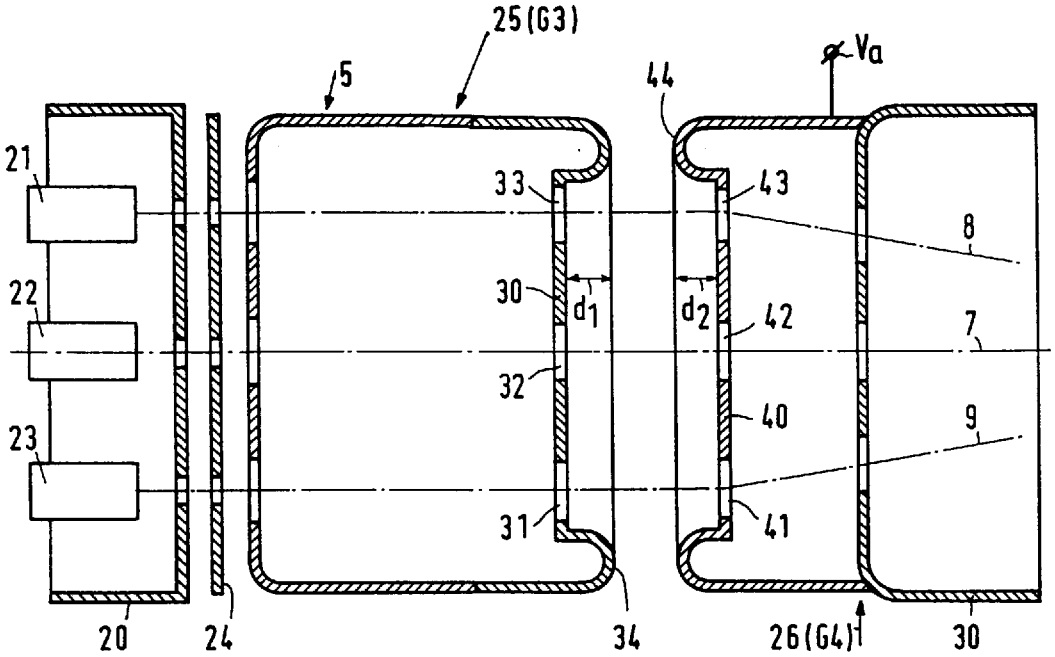
FIG. 3 schematically shows an electron gun for use in a display device in accordance with the invention.
Figure 4:
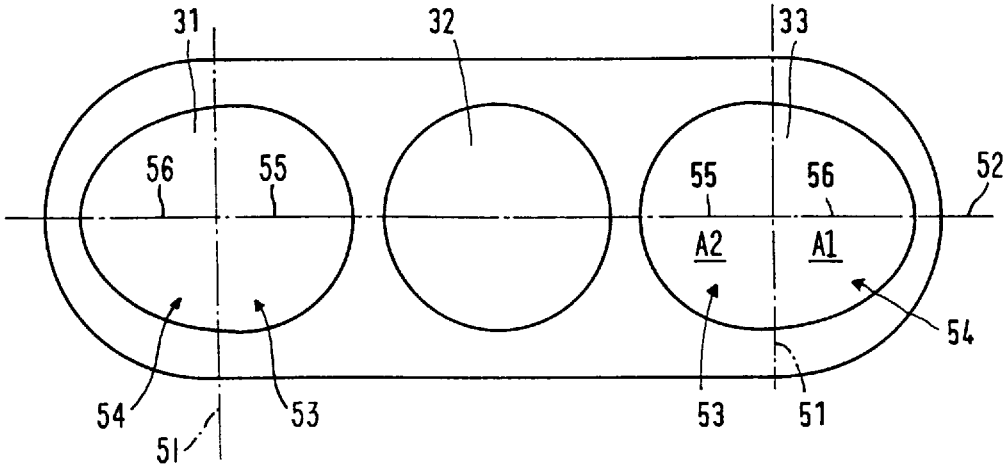
FIG. 4 is a top view of a part of an electrode.
Figure 5A:
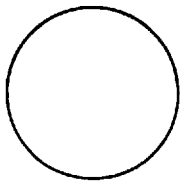
FIGS. 5*a*–5*e* show a number of possible shapes of apertures and the associated left-right asymmetry factor.
Figure 5B:
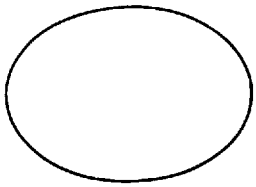
Figure 5C:
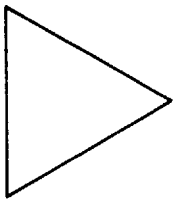
Figure 5D:
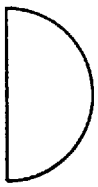
Figure 5E:
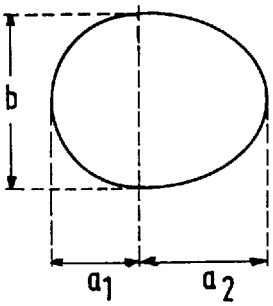
Figure 6:
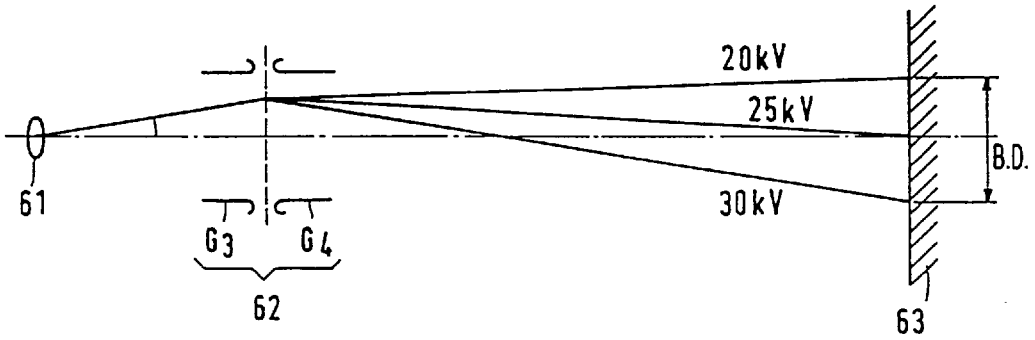
FIG. 6 illustrates the beam displacement.
Figure 8:
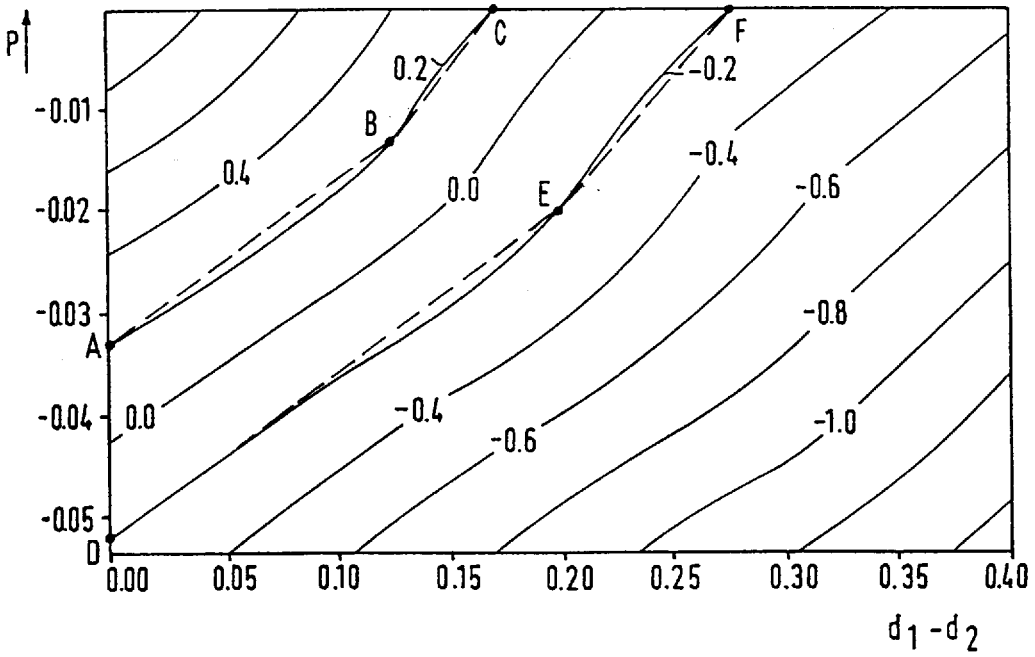
FIG. 8 shows the relationship between the difference in depth, the left-right asymmetry and the beam displacement.
Figure 7A:
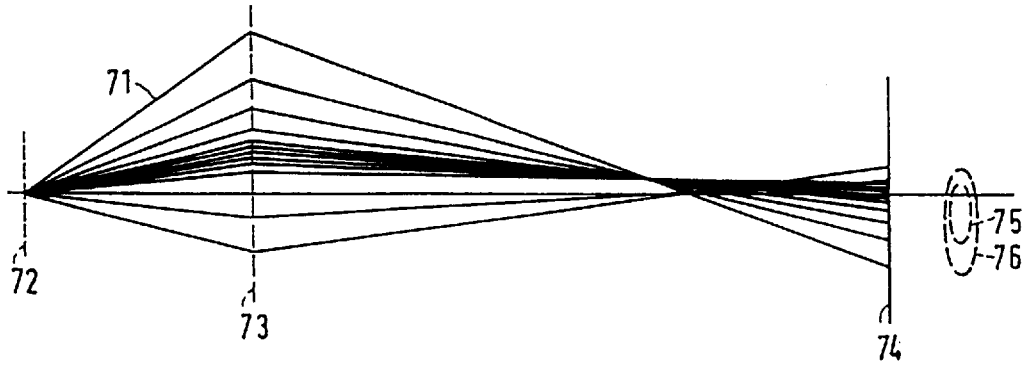
FIGS. 7A and 7B illustrate the core haze asymmetry.
Figure 7B:
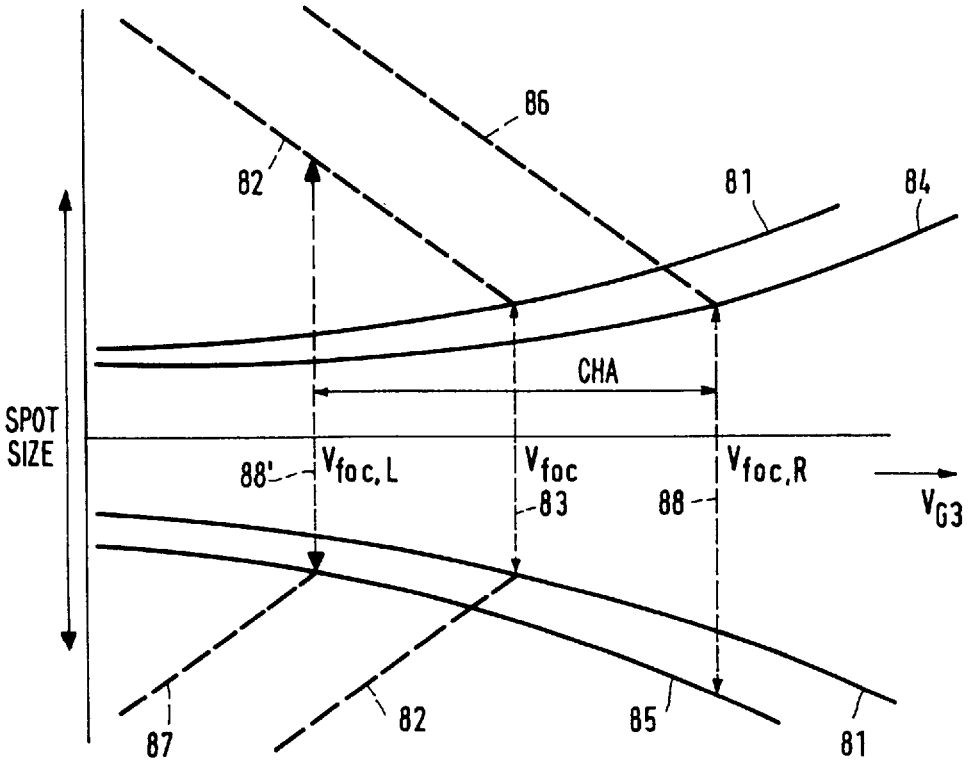
Figure 9:
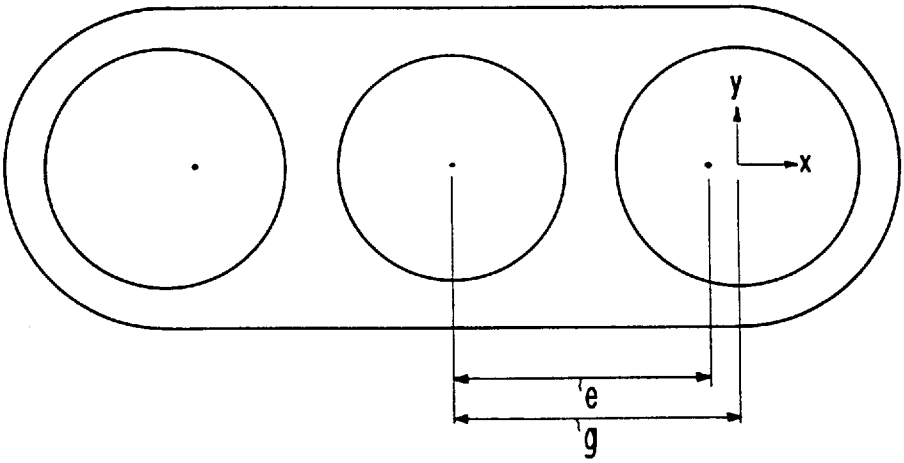
FIG. 9 shows the relationship between the optical pitch and the geometrical pitch of an electrode.
Figure 10:
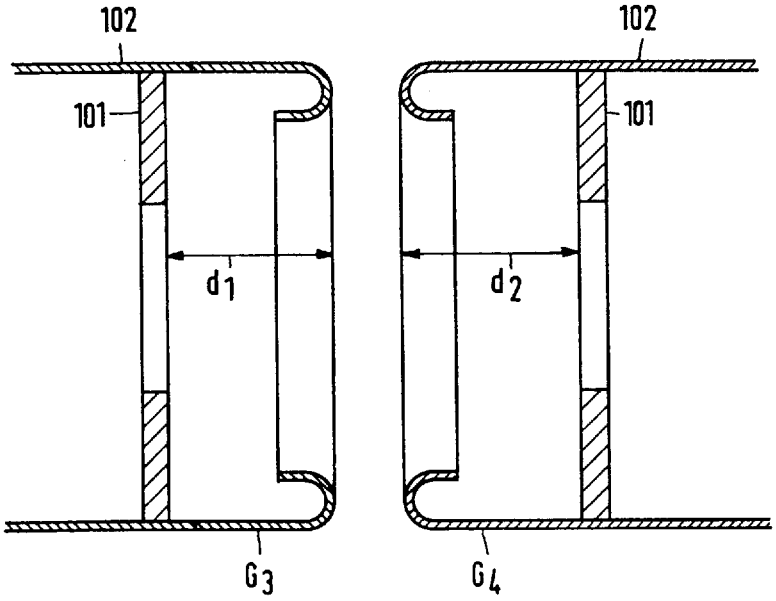
FIG. 10 is a sectional view of an electrode.

In this area, p has a negative value. This is the case if a1 is smaller than a2. A factor p of −0.04 corresponds to a value for a1/(a1+a2) of 0.427, a factor p of −0.01 corresponds approximately to a value of a1/(a1+a2) of 0.4818. A preferred embodiment is characterized in that d1−d2 is zero. In this case, for both electrodes of the main lens use can be made of the same construction, which results in a saving of costs. In FIG. 8, this corresponds to the line segment A–D.

It will be obvious that within the scope of the invention many variations are possible to those skilled in the art.

We claim:

1. A color cathode ray tube comprising an envelope containing a luminescent screen and an electron gun system for producing a central electron beam and first and second outer electron beams along respective axes lying in a common plane, said electron gun system including spaced-apart first and second electrodes, each having a collar and a recessed portion with central and first and second outer apertures for passing the respective electron beams, said electrodes in operation producing therebetween an electro-optic lens for focusing the beams onto the screen, characterized in that:

a. the recessed portions of the first and second electrodes comprise flat plates which are recessed relative to the respective collars by first and second depths, respectively, said collars;

b. each of the first and second outer apertures in the recessed portion of at least one of the first and second electrodes is defined by adjacent outer and inner partial ellipses, having areas of different magnitudes, which meet at a line that is perpendicular to the common plane and equidistant from opposite edges of the respective aperture that intersect said common plane;

said first and second depths and said outer and inner areas having dimensions relative to each other such that the first and second outer electron beams follow paths through the outer apertures of the first and second electrodes for which core haze asymmetry is less than 50 volts and beam displacement at the screen is less than 0.2 mm.

2. A color cathode ray tube comprising an envelope containing a luminescent screen and an electron gun system for producing a central electron beam and first and second outer electron beams along respective axes lying in a common plane, said electron gun system including spaced-apart first and second electrodes, each having a collar and a recessed portion with central and first and second outer apertures for passing the respective electron beams, said electrodes in operation producing therebetween an electro-optic lens for focusing the beams onto the screen, characterized in that:

a. the recessed portions of the first and second electrodes are recessed relative to the respective collars by first and second depths $d_1$ and $d_2$, respectively;

b. each of the first and second outer apertures in at least one of the first and second electrodes is defined by adjacent outer and inner areas A1 and A2, respectively, of different magnitudes, each of said areas being defined by a curved line which meets the other at a centerline that is perpendicular to the common plane and is equidistant from opposite edges of the respective aperture that intersect said common plane, said first and second outer apertures each being described by an asymmetry factor p=A1−A2/A1+A2;

the difference in the depths $d_1$ and $d_2$ being between 0 and approximately 0.27 mm and said asymmetry factor having a negative value between 0 and approximately −0.052.

3. A color cathode ray tube as in claim 2 where the areas A1 and A2, defining the first and second outer apertures in the at least one electrode, each have an elliptical shape.

4. A color cathode ray tube as in claim 2 where, in an $(d_1-d_2)$, (p) cartesian coordinate plot, both the difference in the depths $d_1-d_2$ and the assymetry factor p, for said electron gun system, fall within a hexagonal area having vertices located approximately by the points:

$(d_1-d_2, p)=(0, -0.034)$
$(d_1-d_2, p)=(0.124, -0.0146)$
$(d_1-d_2, p)=(0.169, 0)$
$(d_1-d_2, p)=(0.272, 0)$
$(d_1-d_2, p)=(0.194, -0.022)$
$(d_1-d_2, p)=(0, -0.052)$.

5. A color cathode ray tube as in claim 2 where, in the following $(d_1-d_2)$, (p) cartesian coordinate plot, both the difference in the depths $d_1-d_2$ and the asymmetry factor p, for said electron gun system, fall within the area bounded by the lines 0.2 and −0.2, as shown in FIG. 8, incorporated herein by reference.

6. A color cathode ray tube as in claim 2 where the recessed portion of at least one of the first and second electrodes comprises a flat plate.

* * * * *